United States Patent [19]

Dolan

[11] Patent Number: 4,726,496

[45] Date of Patent: Feb. 23, 1988

[54] TRIGGER ACTUATED SPRAYER DEVICE

[76] Inventor: John E. Dolan, 15 New Main St., Haverstraw, N.Y. 10927

[21] Appl. No.: 907,065

[22] Filed: Sep. 15, 1986

[51] Int. Cl.[4] ..... B67D 5/40

[52] U.S. Cl. ..... 222/384; 239/590; 222/321

[58] Field of Search ..... 222/79, 380, 321, 384, 222/383, 378, 372, 207, 386; 239/333, 590, 553, 600; 137/512.4, 512

[56] References Cited

U.S. PATENT DOCUMENTS

| | | | |
|---|---|---|---|
| 3,228,661 | 1/1966 | Rose | 239/590 |
| 3,897,006 | 7/1975 | Tada | 222/384 |
| 4,153,203 | 5/1979 | Tada | 239/333 |
| 4,266,723 | 5/1981 | Diaz | 239/590 |
| 4,480,768 | 11/1984 | Martin | 222/383 |
| 4,527,741 | 7/1985 | Garneau | 222/383 |
| 4,646,969 | 3/1987 | Sarm et al. | 239/333 |

*Primary Examiner*—Joseph J. Rolla
*Assistant Examiner*—Kenneth Noland
*Attorney, Agent, or Firm*—John F. Ohlandt

[57] ABSTRACT

A trigger-actuated sprayer device useful in connection with a container from which liquid is to be dispensed; the sprayer device has a barrel at the upper part of the sprayer body and a central bore below the barrel; a liquid inlet port is provided in the bottom of the body and an outlet port near its top; a spray chamber is defined within the central bore, and an inlet valve and an outlet valve are respectively associated with the individual ports which are in communication with the spray chamber; an upper bore terminates in an opening at the top of the device body, the upper bore being in communication with the barrel such that the inlet valve is closed when the trigger is depressed and the outlet valve is concurrently opened so as to permit liquid to flow from the spray chamber into the barrel.

8 Claims, 5 Drawing Figures

TRIGGER ACTUATED SPRAYER DEVICE

BACKGROUND OF THE INVENTION

The present invention pertains to devices for spraying cleaning liquid on surfaces to be cleaned and, more particularly, to trigger actuated sprayer devices; as well as to a method of assembling such devices.

Trigger actuated sprayer devices for liquid containers have been known and examples of such devices may be appreciated by reference to U.S. Pat. Nos. 2,678,753 to W. O. Hersey and 3,749,290 to Louis A. Micallef. The former of these relates to a toy pistol for ejecting water or other liquid from a nozzle and provides a hand operated piston-type pump contained within the water storage cavity of the body of the pistol. The Micallef patent discloses a manually operable liquid dispensing pump for use with a liquid container, featuring a tubular member carried by the body of the device, the tubular member having a flexible wall defining a variable volume pump chamber adapted to assume a normal, fully distended position, as well as collapsed position of lesser volume in response to movement inwardly of an operating means in the specific form of a trigger.

SUMMARY OF THE INVENTION

A principal object of the present invention is to provide a trigger actuated sprayer device that is economical to manufacture because it lends itself to computer assisted assembling. Consequently, manufacture of such a sprayer device within the U.S. becomes competitive with the alternative of manufacturing off-shore. Other trigger actuated sprayers, particularly those of the piston-type, do not lend themselves to automated manufacture; hence, they are typically assembled in third world countries because of the lower labor costs that prevail in those countries.

Another object of the present invention is to enable better performance by the trigger actuated sprayer because of the particular construction chosen for the piston.

A further object is to ensure that the device will have a longer life as a result of minimizing piston wear.

Other objects are to eliminate O-rings and the like for sealing purposes; and to require only one spring in the device, thereby minimizing the chance of clogging, as compared with the situation where a multiplicity of springs is involved.

The above and other objects of the present invention are fulfilled and implemented by a number of features in accordance with the present invention.

A primary feature of the invention resides in a piston means retained within a central bore extending longitudinally through the body of the sprayer device; a trigger is so pivoted in said body that it bears against this piston means to urge it rearwardly when the trigger is depressed. By this arrangement the mechanical advantage afforded by the pivoted trigger is obtained; however, the fact that the trigger is unconnected to the piston enables automated assembly because the elements constituting the piston means, that is, the piston itself, a spring utilized for urging the piston forwardly, and a plug for sealing the other elements, can all be forced into the central bore from the rear of the device by a suitable computer-controlled assembling means.

The sprayer device of the present invention will have a longer life because the piston is so constructed that wear on the piston is minimized, the piston itself being constituted of synthetic rubber and formed to be hollow, and to have a smaller diameter forward portion and a larger diameter cup-shaped rear portion. As a consequence of its hollow construction, the piston becomes filled with liquid when liquid is present in a spray chamber defined within the central bore, such that the forward portion of the piston is forced radially outwardly against the forward portion of the central bore, whereby leakage of liquid from the spray chamber is precluded.

Viewed as a total combination, the sprayer device of the invention comprises a piston means retained within the central bore of a plastic body; which bore is adapted to receive a variety of other elements forming the sprayer device; a barrel is provided in the upper part of the body and a spray chamber is defined within the central bore. When the piston is moved rearwardly in response to depression of the trigger, liquid contained within the spray chamber is forced into the barrel and is dispensed from a suitable nozzle at the end of such barrel.

A further specific feature of the present invention resides in the fact that the barrel is provided with a tapered bore and a truncated conical member is disposed on the axis of such bore so as to define therewith a dual chamber for dispensing the liquid.

An additional feature resides in the provision of concentrically spaced, cylindrical shell members depending from the body of the device; a cap to close the container, and a securing means to secure the cap to the body by dint of a friction fit to said shell members.

Yet another feature involves a separately formed valve housing adapted to be automatically friction fitted to a depending tube located interiorly of the spaced shell members.

The present invention also comprehends a method that enables, once the individual elements or components of the sprayer device have been fabricated, efficient and rapid assembling of such components into the body of the device.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
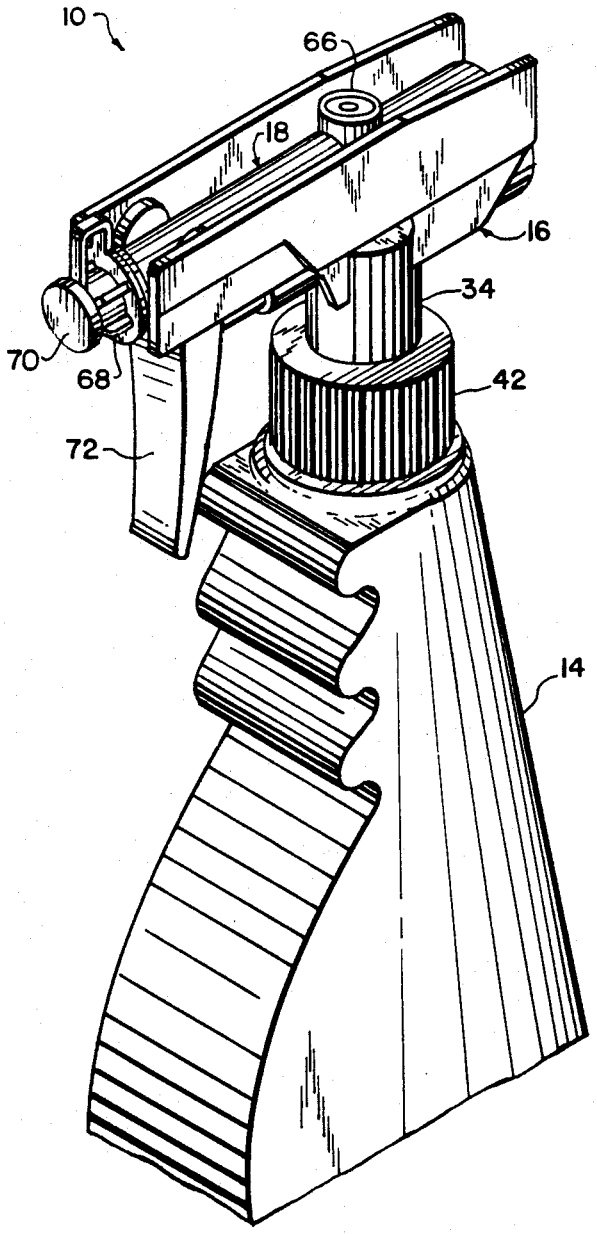
FIG. 1 is a perspective view of the trigger actuated sprayer device fitted on the neck of a container holding cleaning fluid.
Figures 2, 5:
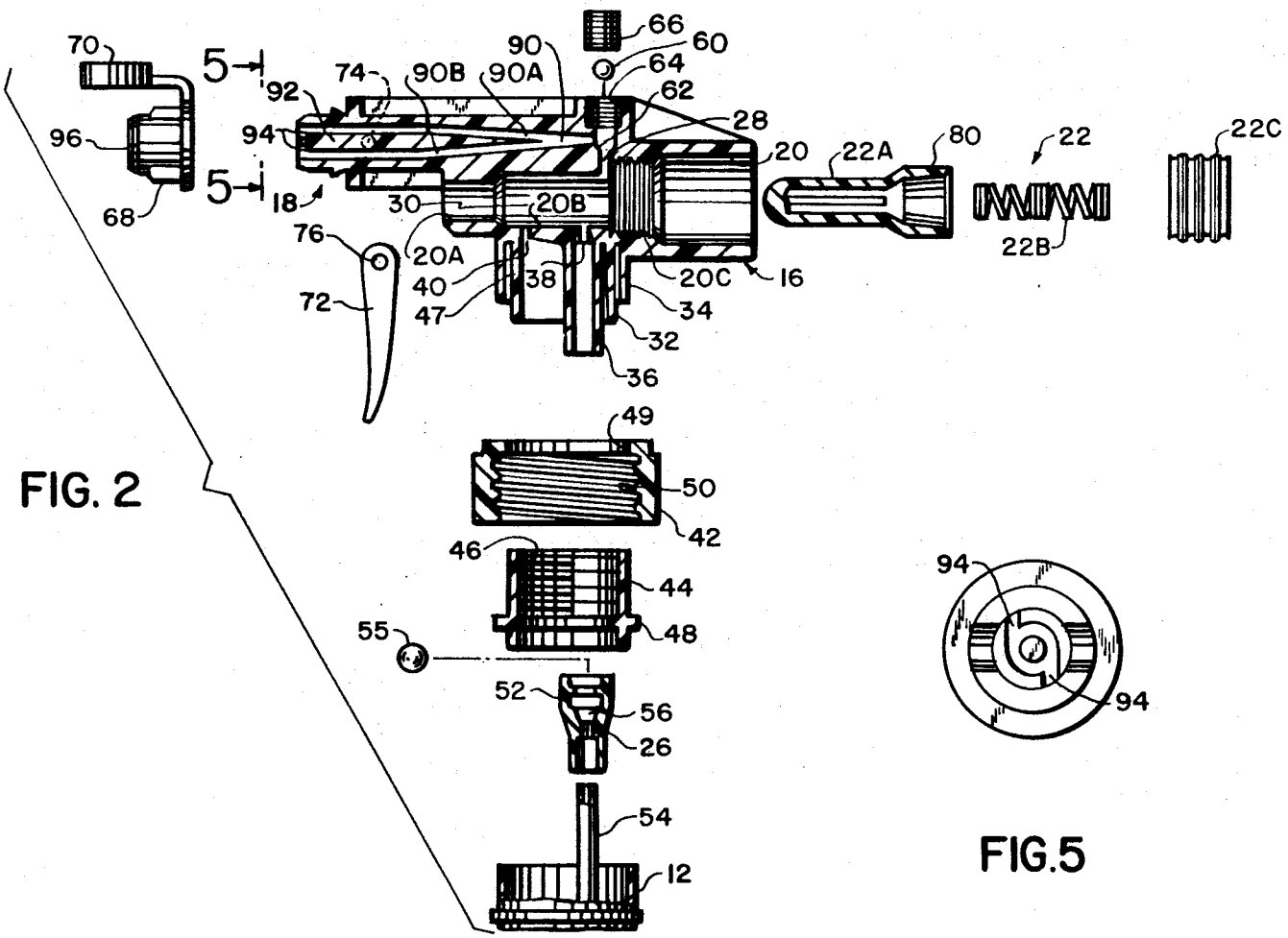
FIG. 2 is an exploded view, partly in section, of the body of the sprayer device and the individual elements or components that are inserted within or attached to the body in forming the complete device.
FIG. 5 is an end view of the barrel of the sprayer device.

Referring now to the figures of the drawing, there is illustrated a sprayer device 10 adapted to be connected to the neck 12 of a container 14 holding the liquid to be dispensed (FIGS. 1 & 2).

The device 10 includes a body 16 which has a barrel 18 extending longitudinally at its upper part. A central bore 20, (FIG. 2) also extending longitudinally, is formed within body 16 located below the barrel 18. The portions of the bore 20 that are adapted for receiving piston means 22 comprising piston 22A, spring 22B, and plug 22C, are designated front portion 20A, middle or intermediate portion 20B, and rear portion 20C.

It will be noted that a liquid inlet port 26 is provided near the bottom of the body 16 and an outlet port 28 near the top of said body.

A spray chamber 30 is defined within the central bore 20, being chiefly defined by the intermediate portion 20B of that bore, but also including the interior of the hollow piston 22A, which normally extends into and beyond the front portion 20A of the central bore 20.

Concentrically spaced cylindrical shell members 32 and 34 depend from the body 16, as does a tube 36 which extends below the shell members. This tube 36 is located interiorly of the cylindrical shell members 32 and 34, being in communication with the chamber 30 by means of an opening 38 in the chamber wall. Another opening 40 for permitting air to pass from the chamber 30 to the interior of container 14 is provided.

Cap 42 serving to seal the contents of container 14 is held by a bushing or securing means 44. This securing means is provided with ribs 46 at its interior surface to insure a friction fit relationship with the inner shell number 32, which has corresponding ribs 47. When the securing means 44 is forced into the space between the two shell members, a flange 48 thereon then abuts against a flange 49 provided on cap 42. Screw threads 50 enable securing the cap 42 to the container 14.

Port 26 is situated within a valve housing 52 whose upper end is frictionally fitted with the tapered lower end of depending tube 36. A dip tube 54, which extends down into the bottle or container 14, has its upper end attached inside the lower end of valve housing 52.

It will be understood that close cooperation exists between a metal ball 55 and a valve seat 56, formed above port 26, which seat is adapted to receive the metal ball, thus together constituting an inlet check valve. Likewise, another metal ball 60 defines an outlet check valve with the valve seat 62. This upper check valve is disposed in a transversely extending upper bore 64, which is directly in communication with the barrel 18 and, by way of the port 28, with the chamber 30. This upper bore is sealed by a plug 66.

Referring to the upper part of the body 16, it will be seen that the barrel 18 includes a tapered bore 90. A longitudinally truncated conical member 92 is disposed on the axis of the bore so as to divide or split the bore 90 into two portions or chambers 90A and 90B. The purpose of this split chamber arrangement is to orient liquid flow and to have a constant pattern without the need for adjustment of the nozzle 68. The cleaning liquid flows through the individual chambers 90A and 90B and enters the tip of the barrel by way of channels 94 in opposite directions, and then exits through opening 96 in the nozzle in the form of a spray. As noted previously, nozzle 68 is friction fitted onto the front end of the barrel such that the end of the conical member 92 fits into opening or hole 96.

It should be noted that conventional trigger actuated sprayers are often designed to maintain the tip of their barrel portion against the nozzle by means of a spring so as to maintain the surface against the tip, which thereby forces the liquid into channels, and they usually provide only a simple hole in the nozzle. The present invention eliminates the use of a spring, thereby eliminating the cost of a part, and possible spring malfunction, as well as eliminating the possibility of clogging due to the presence of a spring.

It will also be noted that in applicant's construction of the cap 42 and the securing means 44, the need for a cap liner has been eliminated since the flange 48 insures sealing of the inside of the neck by reason of its cooperation with flange 49 on the cap 42. Yet it will be appreciated that the cap 42 will fit on a conventional or standard bottle neck.

Nozzle 68 is formed to have its own cap 70 so that the nozzle can be closed off when the device is not in use. As noted previously, the nozzle 68 is frictionally engaged with the front end of barrel 18 by means of pressure applied to the nozzle. Trigger 72 is attached to body 16 by way of a detent means 74 provided on the body so as to receive corresponding special openings 76 in the trigger.

Figure 3:
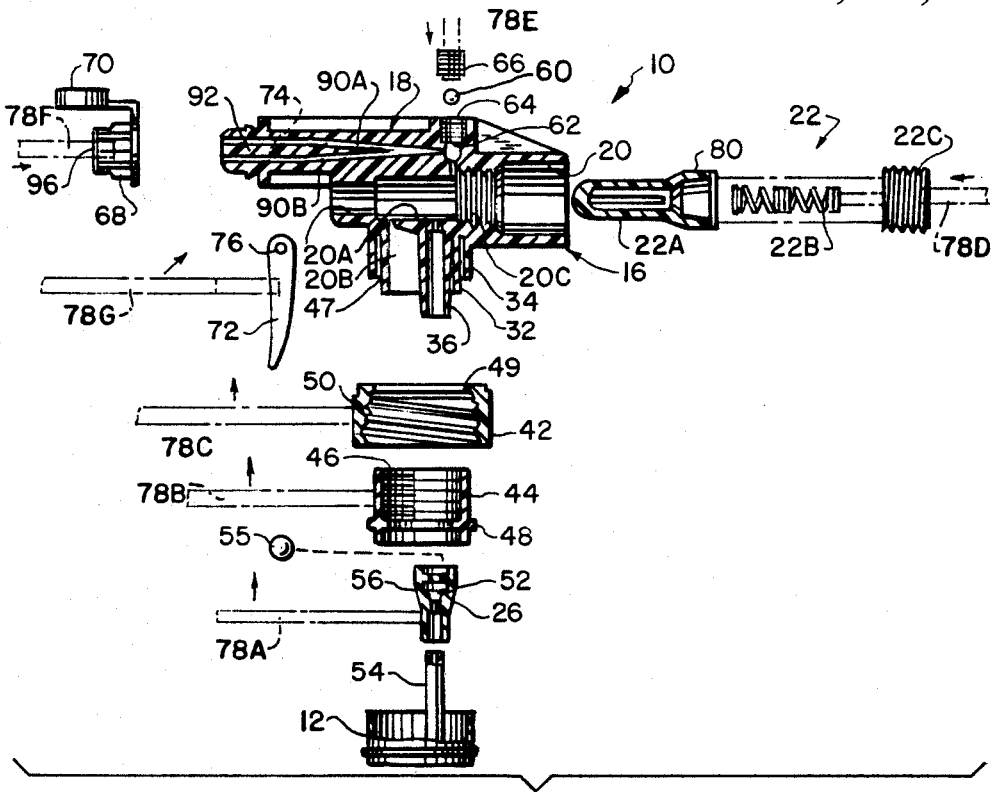
FIG. 3 is another exploded view of the sprayer device, particularly illustrating schematically computer controlled means for providing insertion or attachment of the individual elements or components of the device.
Figure 4:
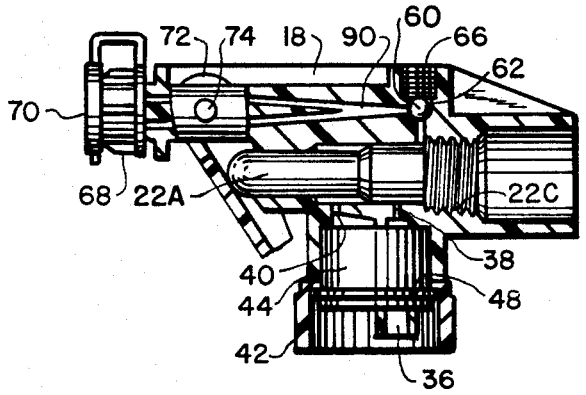
FIG. 4 is another sectional view of the device illustrating the components in assembled position.

Having described the components of the sprayer device of the invention, it is well to consider the method of assembly, also constituting a feature of the invention. As will be particularly seen in FIG. 3, a number of elements of an assembling means 78, which is controlled by a computer, are disposed so as to surround the already formed body 16 which is held in a fixed position when the assembling operation is to take place. The body 16 is composed of ABS plastic material and is formed by a well-known injection molding technique.

After the dip tube 54 has been attached within the lower end of the valve housing 52, the three components, that is the cap 42, bushing or securing means 44, and the valve housing 52 are aligned in a suitable holding device, not seen, and by application of force by the elements 78A, 78B, and 78C of assembling means 78, seen at the bottom of the figure, these three components are so moved that a pressure fit is accomplished between the securing means 44 and the shell members 32 and 34. That is to say, the ribs 46 on securing means 44 engage with the corresponding ribs 47 on the outer surface of shell number 32, the valve housing 52 being at the same time forced into frictional engagement with the lower end of depending tube 36, whereby all three components are then firmly held at the bottom of body 16.

In similar manner, the assembly element 78D, aligned approximately 90 degrees counter-clockwise from the already described components, forces the piston means 22 into the central bore 20 of plastic body 16 such that the ribs on the plug 22C engage with corresponding ribs in the rear portion 20C of the central bore, the spring 228 thereby being forced into the cup-shaped portion 80 of the piston 22A.

Likewise, referring to the upper bore 64 in the body 16, the element 78E of the assembling means forces the plug 66 into the bore 64, the ball 60, forming part of the outlet check valve, having already been seated within valve seat 62. At the forward end of the barrel, nozzle 68 is, by operation of a similar control element 78F, force fitted onto the forward end of barrel 18. Another element 78G of the assembling means serves to force the trigger, having the openings 76, into engagement with detent means 74 on the body of the device.

It will be understood that all of the assembling operations described can be performed simultaneously by suitable computer control of all of the elements forming the assembling means 78.

In operation of the trigger actuated sprayer device 10 of the present invention, the user squeezes the trigger toward his palm, the trigger 72 being unattached to piston 22A. This allows the piston to be pressed back in a straight line, thereby eliminating any rocking motion of the piston. It will be appreciated that although the piston 22A moves in a straight line, the trigger 72 moves at such an angle as to provide leverage and thereby makes it easy to force the piston rearwardly.

It will be understood that in eliminating the rocking motion normally involved in certain piston designs, there is then no need for an O-ring or the like to seal the piston. Instead, the larger sealing surface of piston 22A (that is, of the cup-shaped portion 80 which has a diameter of 5/16 of an inch), and the flexible wall of the piston 22A insures that there will be proper sealing. In the conventional case where an O-ring is used as the seal, the O-ring wears out through repeated squeezing of a trigger and consequently liquid leaks through the piston on the user's hands.

A further notable advantage in connection with applicant's piston construction is that the wear at the outer surface tends to make this area thinner and even more flexible. Hence, the pressure of the liquid in the piston, due to its hollow construction, compensates for this outer surface wear, and so the piston continues to provide sealing after it has been used many more times than a conventional piston sprayer. An additional advantage is that the friction is even more evenly distributed over a larger area than is possible using an O-ring.

It will also be appreciated that by having a smaller diameter (of the order of 3/16 of an inch) at the front portion of the piston chamber 30, there is provided a full guide for the piston so as to enable less wear and leakage. As noted previously, the piston is assembled from the rear of the body 16, this being enabled precisely because the need to connect the trigger to the piston has been obviated.

What happens when the piston is moved rearwardly by depression of trigger 72 is that air intake to the container 14 is allowed through the vent opening 40. On the other hand, when the trigger 72 is released, spring 22B pushes the piston 22A forward and opening 40 is then closed by the cup-shaped portion 80, thereby to prevent leakage. Again, because of the straight line action or movement of piston 22A a close tolerance can be maintained between the cup-shaped portion 80 of the piston and the associated intermediate bore portion 20B.

It will be understood that the lower check valve defined by the ball 58 and the seat 56 is open during the releasing motion of trigger 72. This is a consequence of the vacuum created in spray chamber 30, which causes unseating of the ball 58 such that liquid is pulled through dip tube 54 from the container and into spray chamber 30. At the same time the upper valve is closed by reason of ball 60 being urged against valve seat 62 so as to prevent air intake at nozzle 68.

However, when trigger 72 is depressed and piston 22A is consequently moved rearwardly, the lower valve is closed, ball 58 then being urged against its seat 56. At the same time, the upward liquid pressure unseats ball 60 which allows liquid to flow into the barrel 18.

While there has been shown and described what is considered at present to be the preferred embodiment of the present invention, it will be appreciated by those skilled in the art that modification of such embodiment may be made. It is therefore desired that the invention not be limited to this embodiment, and it is intended to cover in the appended claims all such modifications as fall within the true spirit and scope of the invention.

I claim:

1. A trigger actuated sprayer device used on a container for liquid to be dispensed comprising:

a body for receiving elements forming said sprayer device;

a barrel at the upper part of said body;

a central bore extending longitudinally through said body below said barrel, said central bore being divided into front, intermediate, and rear portions of different diameters;

a piston means retained within said central bore, and a trigger pivoted in said body for bearing against said piston means to urge it rearwardly when said trigger is depressed;

a liquid inlet port near the bottom of said body and an outlet port near the top of said body;

a spray chamber defined within said bore, both said ports being in communication with said spray chamber and having respectively an inlet valve and an outlet valve associated therewith;

said inlet valve being closed when said trigger is depressed, and said outlet valve being concurrently opened so as to permit liquid to flow from said spray chamber into said barrel;

further comprising an opening at the top of said body, an upper bore communicating with said opening, said upper bore extending transversely to said central bore, said upper bore being in communication with said barrel and with said intermediate portion of said central bore, said outlet valve being formed in said upper bore.

2. A device as defined in claim 1, in which said barrel is provided with a tapered bore, and a truncated conical member is disposed on the axis of said tapered bore to define with said bore a dual chamber for dispensing said liquid.

3. A device as defined in claim 2, in which said outlet valve permits liquid to flow from said spray chamber into said dual dispensing chamber.

4. A device as defined in claim 1, in which said piston means includes (a) a spring, and (b) a hollow piston having a small diameter forward portion and a rearward, cup portion of larger diameter, said spring being received within said cup portion;

said piston being filled with liquid when liquid is present in said spray chamber such that the forward portion of said piston is forced radially outwardly against the forward portion of said bore, thereby to prevent leakage of liquid from said spray chamber.

5. A device as defined in claim 4, further comprising a plug for insertion into said rear portion of said bore such that said spring is biased against said piston to urge it forward.

6. A device as defined in claim 1, further comprising concentrically spaced, cylindrical shell members depending from said body; a cap closing said container to seal the liquid contents, a securing means for securing said cap to said body, said securing means being received in the space defined between said concentrically spaced cylindrical shell members.

7. A device as defined in claim 6, further including a tube depending from said body, said tube being located interiorly of said concentrically spaced cylindrical shell members, and being in communication with the intermediate portion of said bore; a valve housing defining said inlet valve and adapted to be attached to the lower end of said depending tube in a friction fit relationship; a dip tube extending down within said container, the upper end thereof being attached to said valve housing.

8. A device as defined in claim 1, further comprising a nozzle adapted to be attached to the end of said barrel for providing a liquid spray, said nozzle including an opening and an integrally formed cap to close said opening.

* * * * *